US008550858B2

(12) United States Patent
Reid

(10) Patent No.: US 8,550,858 B2
(45) Date of Patent: Oct. 8, 2013

(54) EXTENSIBLE MEMORY CARD-COMPATIBLE RECEPTACLE AND PORT EXPANSION DEVICE

(75) Inventor: Gavin Reid, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/082,212

(22) Filed: Apr. 7, 2011

(65) Prior Publication Data

US 2011/0250786 A1 Oct. 13, 2011

Related U.S. Application Data

(60) Provisional application No. 61/321,735, filed on Apr. 7, 2010.

(51) Int. Cl.
*H01R 25/00* (2006.01)

(52) U.S. Cl.
USPC ..... 439/639; 439/630

(58) Field of Classification Search
USPC ..... 439/638, 639, 630
See application file for complete search history.

(56) References Cited

U.S. PATENT DOCUMENTS 5,457,601 A * 10/1995 Georgopulos et al. ... 361/679.32
5,752,857 A * 5/1998 Knights ..... 439/638
5,984,731 A * 11/1999 Laity ..... 439/676
6,068,500 A * 5/2000 Kantner ..... 439/218
6,069,795 A * 5/2000 Klatt et al. ..... 361/737
6,097,605 A * 8/2000 Klatt et al. ..... 361/737
6,164,989 A * 12/2000 Glad et al. ..... 439/131
6,173,405 B1 * 1/2001 Nagel ..... 726/21
6,174,205 B1 * 1/2001 Madsen et al. ..... 439/638
6,217,351 B1 * 4/2001 Fung et al. ..... 439/131
6,219,256 B1 * 4/2001 Wu ..... 361/801
6,276,944 B1 * 8/2001 Klatt ..... 439/76.1
6,353,870 B1 * 3/2002 Mills et al. ..... 710/301
6,390,855 B1 * 5/2002 Chang ..... 439/638
6,413,108 B2 * 7/2002 Centofante ..... 439/267
6,434,010 B1 * 8/2002 Hsu ..... 361/737
6,457,647 B1 * 10/2002 Kurihashi et al. ..... 235/486
6,461,170 B1 * 10/2002 Oliphant et al. ..... 439/76.1
6,524,137 B1 * 2/2003 Liu et al. ..... 439/638
6,567,273 B1 * 5/2003 Liu et al. ..... 361/737
6,612,492 B1 * 9/2003 Yen ..... 235/451
6,665,190 B2 * 12/2003 Clayton et al. ..... 361/736
6,671,764 B2 * 12/2003 Martin ..... 710/301
6,672,904 B1 * 1/2004 Chen ..... 439/631
6,681,991 B1 * 1/2004 Li ..... 235/439
6,738,259 B2 * 5/2004 Le et al. ..... 361/737
6,761,313 B2 * 7/2004 Hsieh et al. ..... 235/451
6,761,320 B1 * 7/2004 Chen ..... 235/492

(Continued)

OTHER PUBLICATIONS

'SD adapter for USB memory pens: Mobidaptere, [online]. © 2002-2008 Elan Digital Systems Ltd. [retrieved on Nov. 5, 2009]. Retrieved from the Internet: <URL:http://www.elandigitaisystems.com/adapter/mobidapter.php>, 2 pgs.

*Primary Examiner* — Ross Gushi
(74) *Attorney, Agent, or Firm* — Kilpatrick Townsend & Stockton LLP

(57) ABSTRACT

Systems, apparatus, and methods for expanding a memory card-compatible receptacle for use with a multitude of other connections are provided. In an embodiment, a memory card-compatible receptacle having two sets of contact points communicates with a port expansion device to provide an interface with more commonly used ports.

25 Claims, 5 Drawing Sheets

(56) References Cited

U.S. PATENT DOCUMENTS 6,764,346 B2 * 7/2004 Fujita et al. ..... 439/638
6,773,308 B2 * 8/2004 Lwee ..... 439/630
6,783,076 B2 * 8/2004 Kondo et al. ..... 235/492
6,783,399 B2 * 8/2004 Joung ..... 439/630
6,808,424 B2 * 10/2004 Kaneshiro et al. ..... 439/638
6,821,155 B2 * 11/2004 Hsieh ..... 439/630
6,830,474 B2 * 12/2004 Liu et al. ..... 439/489
6,900,982 B2 * 5/2005 Chang et al. ..... 361/679.31
6,926,559 B1 * 8/2005 Hung et al. ..... 439/630
6,932,623 B2 * 8/2005 Lai ..... 439/76.1
6,969,281 B2 * 11/2005 Lai ..... 439/630
6,976,624 B2 * 12/2005 Hsiao ..... 235/451
6,979,201 B1 * 12/2005 Lee et al. ..... 439/64
7,014,484 B2 * 3/2006 Hagiwara ..... 439/159
7,025,637 B1 * 4/2006 Lee ..... 439/638
7,033,223 B1 * 4/2006 Lin ..... 439/630
7,052,295 B1 * 5/2006 Lin ..... 439/159
7,070,453 B1 * 7/2006 Chen ..... 439/630
7,094,106 B2 * 8/2006 Yamamoto et al. ..... 439/630
7,097,512 B1 * 8/2006 Hsiao et al. ..... 439/630
7,112,074 B2 * 9/2006 Nakai et al. ..... 439/159
7,118,421 B2 * 10/2006 Kadonaga et al. ..... 439/638
7,152,801 B2 * 12/2006 Cuellar et al. ..... 235/492
7,162,547 B2 * 1/2007 Hosaka et al. ..... 710/8
7,172,464 B1 * 2/2007 Lee ..... 439/630
7,179,129 B1 * 2/2007 Hwang ..... 439/630
7,189,118 B2 * 3/2007 Lee ..... 439/630
7,194,565 B2 * 3/2007 Mills et al. ..... 710/301
7,210,967 B1 * 5/2007 Lee ..... 439/630
7,226,318 B1 * 6/2007 Lee ..... 439/630
7,234,969 B2 * 6/2007 Chang et al. ..... 439/630
7,249,975 B1 * 7/2007 Liu et al. ..... 439/630
7,314,388 B2 * 1/2008 Yamada et al. ..... 439/630
7,320,622 B2 * 1/2008 Ying et al. ..... 439/630
7,326,086 B1 * 2/2008 Lee et al. ..... 439/630
7,341,461 B1 * 3/2008 Yen et al. ..... 439/76.1
7,355,860 B2 * 4/2008 Miller et al. ..... 361/737
7,364,468 B2 * 4/2008 Liu et al. ..... 439/638
7,367,503 B2 * 5/2008 Harai et al. ..... 235/441
7,371,119 B1 * 5/2008 Lee ..... 439/630
7,375,958 B2 * 5/2008 Kuroda et al. ..... 361/679.32
7,382,625 B2 * 6/2008 Thornton et al. ..... 361/737
7,384,314 B1 * 6/2008 Xu ..... 439/630
7,404,741 B2 * 7/2008 Tanaka et al. ..... 439/630
7,410,376 B2 * 8/2008 Ying et al. ..... 439/159
7,425,157 B1 * 9/2008 Hung ..... 439/630
7,427,026 B2 * 9/2008 Kojima et al. ..... 235/441
7,427,032 B2 * 9/2008 Osako et al. ..... 235/492
7,464,213 B2 * 12/2008 Fukuda ..... 710/301
7,485,005 B1 * 2/2009 Chi ..... 439/630
7,505,277 B2 * 3/2009 Tracy et al. ..... 361/741
7,513,801 B2 * 4/2009 Cheng et al. ..... 439/638
7,522,424 B2 4/2009 Mambakkan et al.
7,614,916 B2 * 11/2009 Jow ..... 439/630
7,686,654 B2 * 3/2010 Hubert et al. ..... 439/638
7,699,660 B2 * 4/2010 Hubert et al. ..... 439/630
7,771,238 B2 * 8/2010 Aoki et al. ..... 439/630
7,822,883 B2 * 10/2010 Miller et al. ..... 710/11
7,859,850 B2 * 12/2010 Chan et al. ..... 361/737
RE42,410 E * 5/2011 Yamada et al. ..... 439/630
7,934,946 B2 * 5/2011 Alejandro et al. ..... 439/489
8,016,618 B2 * 9/2011 Takai et al. ..... 439/630
8,092,257 B2 * 1/2012 Hubert et al. ..... 439/638
8,102,658 B2 * 1/2012 Hiew et al. ..... 361/737
8,109,772 B2 * 2/2012 Lin ..... 439/76.1
2002/0032813 A1 * 3/2002 Hosaka et al. ..... 710/62
2002/0178307 A1 * 11/2002 Pua et al. ..... 710/62
2003/0038177 A1 * 2/2003 Morrow ..... 235/441
2003/0084220 A1 * 5/2003 Jones et al. ..... 710/301
2003/0201322 A1 * 10/2003 Wu ..... 235/441
2003/0235040 A1 * 12/2003 Liu et al. ..... 361/737
2004/0002264 A1 * 1/2004 Yao ..... 439/638
2004/0033722 A1 * 2/2004 Liu et al. ..... 439/630
2004/0041024 A1 * 3/2004 Liu et al. ..... 235/441
2004/0042323 A1 * 3/2004 Moshayedi ..... 365/232
2004/0050934 A1 * 3/2004 Chen et al. ..... 235/441
2004/0087213 A1 * 5/2004 Kao ..... 439/638
2004/0106326 A1 * 6/2004 Hsieh ..... 439/630
2004/0229511 A1 * 11/2004 Chen ..... 439/638
2005/0037647 A1 * 2/2005 Le ..... 439/131
2005/0085130 A1 * 4/2005 Lai ..... 439/638
2005/0088829 A1 * 4/2005 Igarashi ..... 361/737
2005/0159048 A1 * 7/2005 Hung et al. ..... 439/630
2005/0176304 A1 * 8/2005 Yiu ..... 439/630
2005/0182858 A1 * 8/2005 Lo et al. ..... 710/1
2005/0185371 A1 * 8/2005 Kuroda et al. ..... 361/684
2005/0225950 A1 * 10/2005 Matsuda et al. ..... 361/737
2005/0230484 A1 * 10/2005 Cuellar et al. ..... 235/492
2005/0239335 A1 * 10/2005 Kadonaga et al. ..... 439/638
2005/0258243 A1 * 11/2005 Hsieh ..... 235/441
2005/0273648 A1 * 12/2005 Mambakkam et al. ..... 714/5
2006/0014434 A1 * 1/2006 Yamamoto et al. ..... 439/630
2006/0112209 A1 * 5/2006 Yao ..... 710/301
2006/0149855 A1 * 7/2006 Fukuda ..... 710/2
2006/0166559 A1 * 7/2006 Nakai et al. ..... 439/630
2006/0194479 A1 * 8/2006 Osako et al. ..... 439/638
2006/0223376 A1 * 10/2006 Chang et al. ..... 439/630
2006/0237539 A1 * 10/2006 Chang et al. ..... 235/441
2006/0243801 A1 * 11/2006 Chen ..... 235/441
2006/0253636 A1 * 11/2006 Jones et al. ..... 710/301
2007/0004285 A1 * 1/2007 Lee ..... 439/638
2007/0026740 A1 * 2/2007 Chen ..... 439/630
2007/0034699 A1 * 2/2007 Lin ..... 235/486
2007/0099511 A1 * 5/2007 Miller et al. ..... 439/630
2007/0161301 A1 * 7/2007 Chuang ..... 439/946
2007/0162676 A1 7/2007 Hsu et al.
2007/0180177 A1 * 8/2007 Jones et al. ..... 710/301
2007/0207676 A1 * 9/2007 Ying et al. ..... 439/630
2007/0218768 A1 * 9/2007 Lee ..... 439/630
2007/0259570 A1 * 11/2007 Moshayedi ..... 439/638
2007/0288677 A1 * 12/2007 Mambakkam et al. ..... 710/301
2008/0076302 A1 * 3/2008 Chi ..... 439/638
2008/0153358 A1 * 6/2008 Tanaka et al. ..... 439/638
2008/0270663 A1 * 10/2008 Fry et al. ..... 710/301
2009/0006682 A1 * 1/2009 Hubert et al. ..... 710/100
2009/0006698 A1 * 1/2009 Hubert et al. ..... 710/301
2009/0061688 A1 * 3/2009 Aoki et al. ..... 439/628
2009/0124129 A1 * 5/2009 Moshayedi ..... 439/638
2010/0105251 A1 * 4/2010 Hiew et al. ..... 439/638

* cited by examiner

EXTENSIBLE MEMORY CARD-COMPATIBLE RECEPTACLE AND PORT EXPANSION DEVICE

CLAIM OF PRIORITY

This application claims the benefit of priority under 35 U.S.C. §119(e) to U.S. Patent Application Ser. No. 61/321,735, filed Apr. 7, 2010, which is hereby incorporated by reference herein in its entirety.

BACKGROUND

The present disclosure relates generally to ports and port adapters and the methods of their operation, and more particularly relates to a memory card-compatible receptacle engageable with a port expansion device for providing extensible connectivity for a processor-based system.

Many processor-based systems, such as mobile phones, cameras, desktops, laptops, digital music players, and the like, have multiple input/output ports for interfacing various devices with the processing system. Input/output ports, which are commonly found, include one or more of Universal Serial Bus (USB), Firewire400 & 800, Ethernet (e.g., RJ-45), Serial ports, Parallel ports, Personal System/2 (PS/2), Video Graphics Array (VGA), Digital Visual Interface (DVI), DisplayPort and Mini-Display Port, as well as others. One class of "memory card reader" ports is used to read and write to media cards, such as CompactFlash (CF), MemoryStick, Secure Digital (SD), and Multi-Media Card (MMC).

Some ports, such as USB or FireWire, are often in use for extended periods of time. While the card reader class of ports is often used momentarily to transfer information to or from the processing system and, when not in use, often remains idle. With many processor-based systems becoming ever smaller and thinner relative to prior counterpart devices, inclusion of a memory card reader port can often limit space for more consistently used ports.

SUMMARY

The disclosure describes a memory card receptacle configured to engage a port expansion device, to provide expanded connectivity to a host system; and further discloses a port expansion device suitable for use with such a receptacle. The port expansion device is capable of engaging the memory card-compatible receptacle, and is configured to engage one or more connectors of devices; which in many embodiments, will include one or more connectors where at least one will be of a different type than the memory card that the receptacle is configured to engage. In some embodiments, the connectors may include one or more of an Ethernet connector, a Universal Serial Bus (USB), an audio connector, or any of a wide variety of connectors for ports, examples of which are described later herein. In some examples, the memory card-compatible receptacle includes two sets of contacts, where one set is configured to engage a memory card or a similar structure with similar contacts, and the other set is configured to engage electrical contact surfaces the port expansion device.

DETAILED DESCRIPTION

The following detailed description refers to the accompanying drawings that depict various details of examples selected to show how particular embodiments may be implemented. The discussion herein addresses various examples of the inventive subject matter at least partially in reference to these drawings and describes the depicted embodiments in sufficient detail to enable those skilled in the art to practice the invention. Many other embodiments may be utilized for practicing the inventive subject matter than the illustrative examples discussed herein, and many structural and operational changes in addition to the alternatives specifically discussed herein may be made without departing from the scope of the inventive subject matter.

In this description, references to "one embodiment" or "an embodiment," or to "one example" or "an example" mean that the feature being referred to is, or may be, included in at least one embodiment or example of the invention. Separate references to "an embodiment" or "one embodiment" or to "one example" or "an example" in this description are not intended to necessarily refer to the same embodiment or example; however, neither are such embodiments mutually exclusive, unless so stated or as will be readily apparent to those of ordinary skill in the art having the benefit of this disclosure. Thus, the present disclosure includes a variety of combinations and/or integrations of the embodiments and examples described herein, as well as further embodiments and examples as defined within the scope of all claims based on this disclosure, as well as all legal equivalents of such claims.

For the purposes of this specification, "computing device," "computing system," "processor-based system" or "processing system" includes a system that uses one or more processors, microcontrollers and/or digital signal processors and that has the capability of running a "program." As used herein, the term "program" refers to a set of executable machine code instructions, and as used herein, includes user-level applications as well as system-directed applications or daemons, including operating system and driver applications. Processing systems can include communication and electronic devices, such as mobile phones (cellular or digital), music and multi-media players, electronic reading device, and Personal Digital Assistants (PDA); as well as computers, or "computing devices" of all forms (desktops, laptops, servers, palmtops, workstations, tablet devices, notebooks, netbooks, etc.).

Figure 1A:
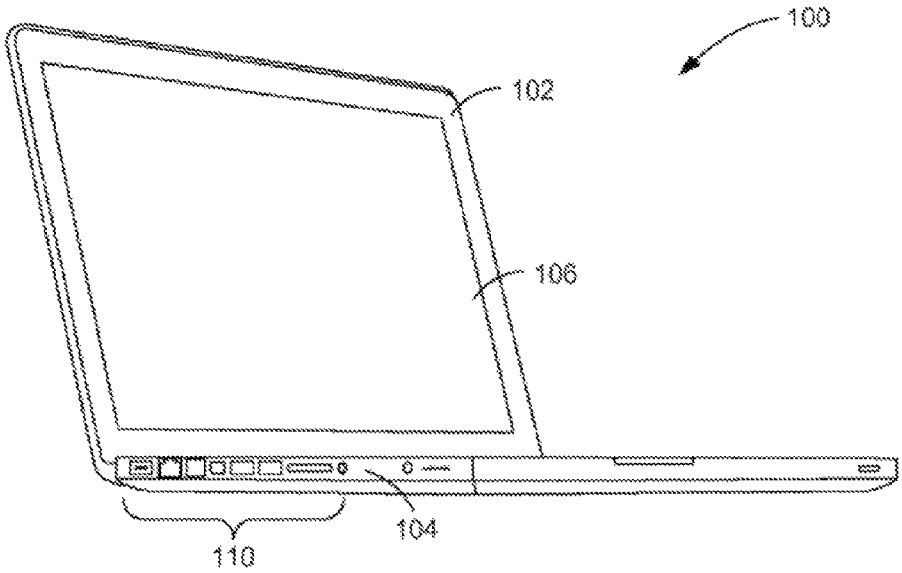
FIG. 1A illustrates an angled side view of an example system with a plurality of input/output ports.

FIG. 1A illustrates an angled side view 100 of an example processing system 102 with a plurality of input/output (I/O) port, the connectors of which are indicated at 110. As can be seen in the Figure, processing system 102 is in the example form of a notebook computer. For the purposes of this specification, the "I/O ports" include the components of a system 102 serving as a mechanical and electrical interface between the system 102 and external electrical devices, frequently according to a specific protocol (e.g., USB, FireWire, etc.) and capable of physically and electrically coupling with connectors associated with electrical devices, either directly, or through a cable, dongle or similar mechanism; and thus includes the physical connector associated with that port type. Thus, a user can connect a device to a respective I/O port through the port connector 110. The I/O port 110 connectors can be positioned on a side surface 104 of the system 102, as depicted; or may be distributed around other surfaces of the device as desired and as both surface space and the internal arrangement of components in the processing system permit. Processing system 102 is adapted to receive input signals generated by the components and devices connected to the I/O ports 110 and/or to output signals through the ports, as is well known in the art.

Processing system 102 can include a display device 106, which in some cases can be used to display information received from the components connected to the I/O ports of the system. During operation, when a component is connected to the system 102 via the I/O ports, the display device can display information related to components connected to the I/O ports (e.g., a navigational object, files stored on a memory card, connectivity of devices, etc.). In the example form of processing system 102 in the form of a notebook computer, one common configuration for the display device would be a TFT or LED display. However, other types of processing devices may use different display types. Accordingly, as used herein, the term "display device" can include any type of device adapted to display information, including without limitation, cathode ray tube displays (CRTs), liquid crystal displays (LCDs), thin film transistor displays (TFTs), digital light processor displays (DLPs), plasma displays, light emitting diodes (LEDs) or diode arrays, incandescent devices, and fluorescent devices. Display devices may also include less dynamic display devices, including electronic ink displays and similar devices.

Figure 1B:
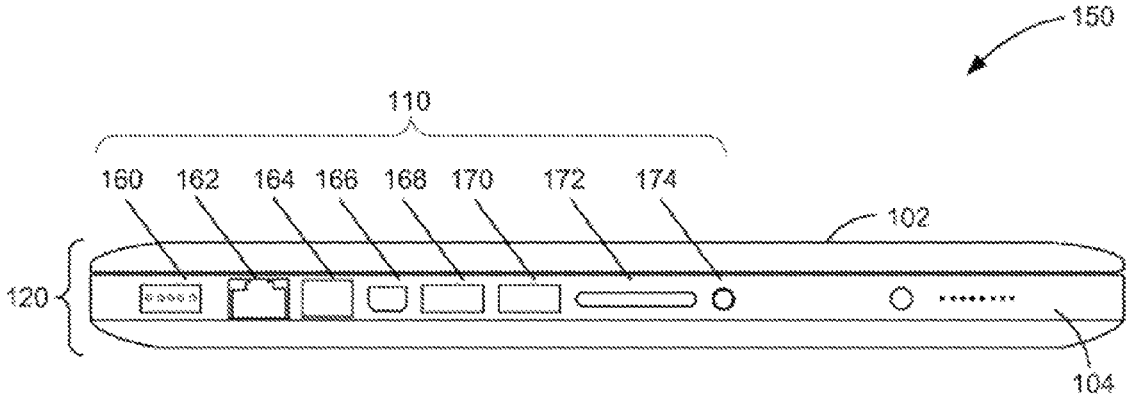
FIG. 1B illustrates a side view of an example system with a plurality of input/output ports located on a side external surface of the system.

FIG. 1B illustrates a side view 150 of processing system 102 depicting input/output (I/O) port connectors 110 located on a side external surface of the system 102. In this example, the I/O ports include the following ports and associated connectors: Magsafe® power port 160, Gigabit Ethernet port 162, FireWire 800 port 164, Mini DisplayPort 166, a first universal service bus (USB) port 168, a second USB port 170, memory card port 172, and an audio out port 174. In some examples, greater or fewer I/O ports can be included, and additional port types can also be included, such as, by way of example only, serial ports, parallel ports, PS/2 connectors, VGA connectors, etc.

Physical dimensions of the I/O port connectors 110 can determine the physical dimensions of the processing system 102, such as a height dimension 120. As an example, the Ethernet port connector 162 has a greater height dimension than other port connectors such as those of the USB ports 168 and 170 and the memory card-compatible port 172. Thus, integrating an Ethernet port connector 162, such as a standard 8P8C (RJ45) can determine the height dimension 120 of the processing system 102, or at least of a pertinent component of the system. Ethernet port connector 162 may have a height in the range of about 20 mm to about 25 mm, whereas, by comparison, the height of a memory-card port can be in the range of about 1.2 mm to about 3 mm. Thus, a system 102, or system component, without an integrated Ethernet port 162 can have a smaller height dimension 120 than a system 102 or component with an integrated Ethernet port 162. Thus, even though it may be desirable to occasionally use a certain port, such as a Ethernet port (with a relatively larger connector) with a device, inclusion of such a port may be an unacceptable trade-off, particularly if it requires an undesirable change in the form factor of the host processing system.

Figure 2:
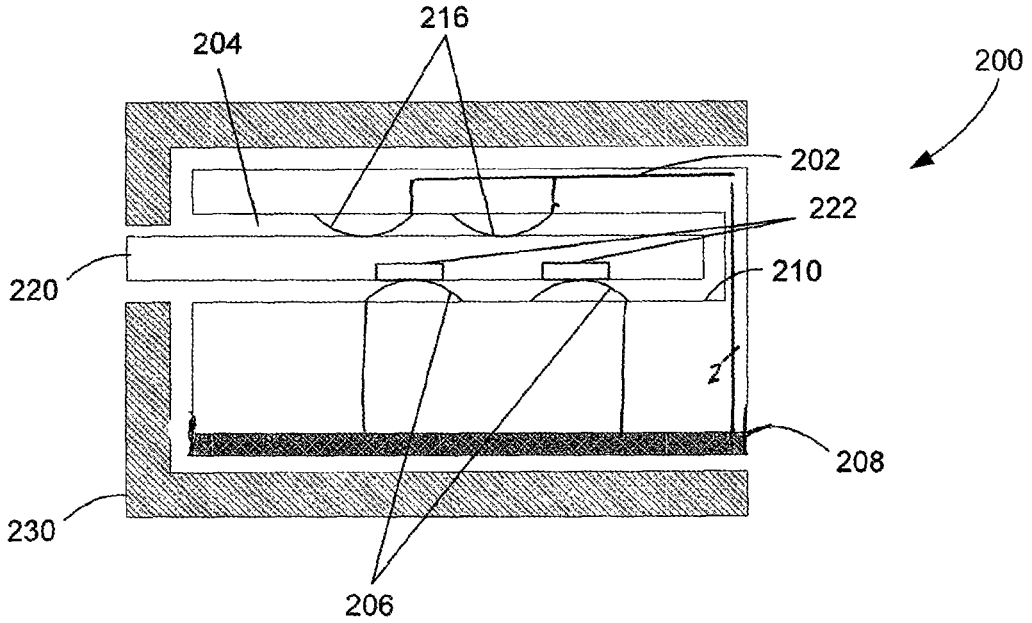
FIG. 2 is a cross-sectional view of a block diagram illustrating an example memory card-compatible receptacle with contacts for engaging a memory card.

FIG. 2 is a cross-sectional view 200 of a block diagram representation of an example memory card-compatible "slot" or receptacle 202. Memory card-compatible receptacle 202 includes a first set of contacts 206, located on a first side of card-receiving space 204, for engaging a side-contact memory card 220, such as the SD and MMC memory cards. Such SD and MMC memory cards have contacts 222 for the card only on a single side of the card. Memory card-compatible receptacle 202 includes a second set of contacts 216 for engaging contact surfaces of a port expansion device. In this example configuration, the contacts of the second set 216 serve no function when a SD or MMC card is engaged in the receptacle, as they contact only a non-conductive side of the card. In the depicted example, the memory card-compatible receptacle 202 also includes a communication portion 208 for communicating between contacts 206, 216 and other components such as a processor of the processing system that includes memory card-compatible receptacle 202. The card-receiving space 204 will be sized and shaped to receive one or more variations of a memory card 220, and may include one or more structures serving as "keys" to allow the memory card to be inserted only in the single intended orientation. In many embodiments, the memory card-compatible receptacle 202 will be internally located within the system 230.

Figure 3A:
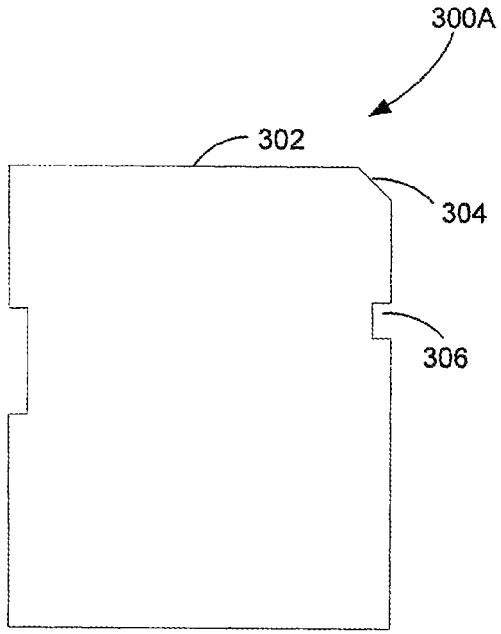
PRIOR ART FIG. 3A
FIGS. 3A and 3B respectively illustrate an example top side and a bottom side of a secure digital card.
Figure 3B:
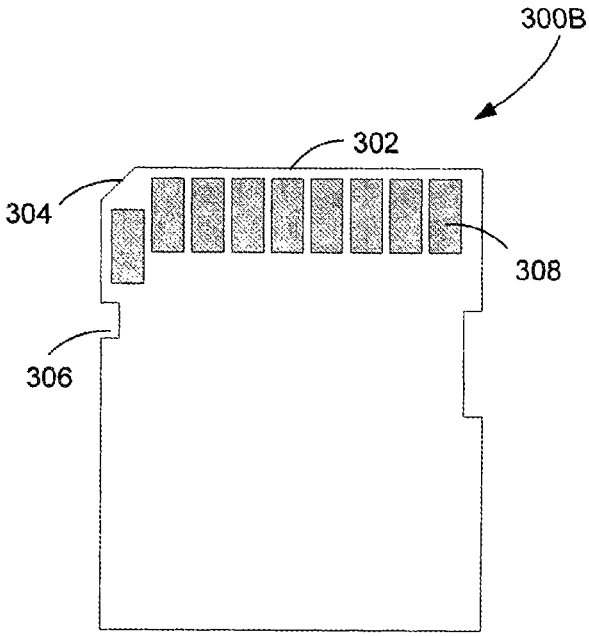
PRIOR ART FIG. 3B

Referring now to FIGS. 3A-3D, the Figures depict top side views and bottom side views of two example memory cards compatible with the memory card-compatible receptacle 202 depicted in FIG. 2. FIGS. 3A and 3B respectively illustrate an example top plan view 300A and a bottom plan view 300B of an example Secure Digital (SD) memory card 302. The top surface of the SD memory card 302 has a flat surface and does not include contacts; while the bottom includes a set of contact surfaces 308. The set of contact surfaces 308 will be in a designated pattern in accordance with the SD card standard, to communicatively couple the memory card 302 with the first set of contacts 206 of the memory card port 202 which are arranged in a complimentary pattern. The SD memory card includes a first notch 304 at the top right hand corner and a second notch 306 that cooperates with keys in the receptacle (as discussed above), to orient the memory card when inserting into a memory card-compatible receptacle. Proper orientation when inserting the memory card 302 into the card-receiving space 204 of the memory card port 202 ensures engagement of the set of contact surfaces 308 of the memory card 302 with the first set of contacts 206 of FIG. 2.

Figure 3C:
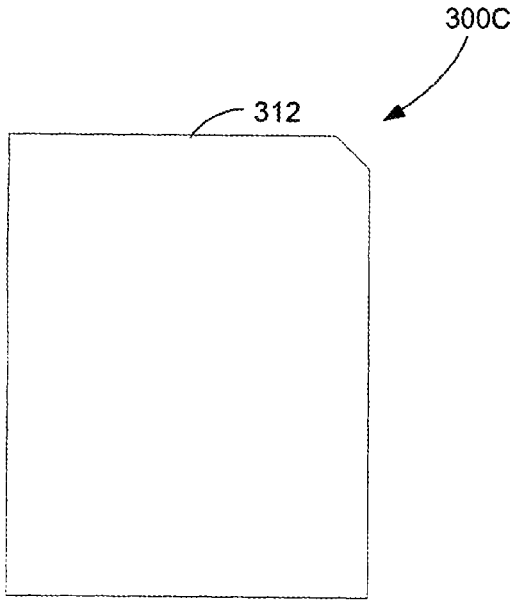
PRIOR ART FIG. 3C
FIGS. 3C and 3D respectively illustrate an example top side and bottom side of a MultiMediaCard.
Figure 3D:
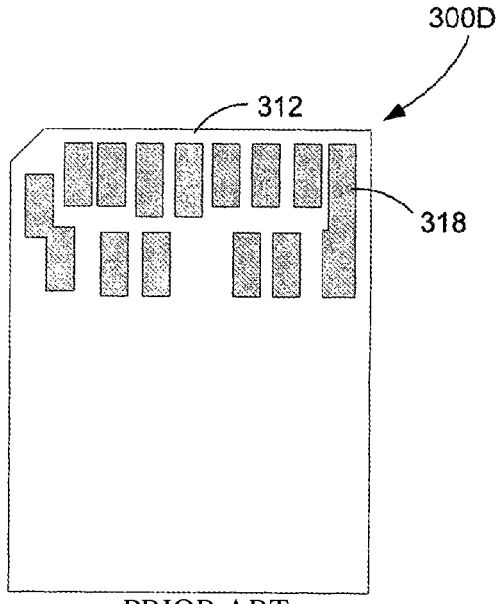
PRIOR ART FIG. 3D

FIGS. 3C and 3D respectively illustrate a top plan view 300C and a bottom plan view 300D of a MultiMediaCard (MMC) memory card 312. As depicted in the Figures, MMC memory card 312, again, does not include any contact surfaces on the top side; but includes a plurality of contact surfaces 318, arranged generally in two rows, on the bottom side. In many cases, a card slot configured to receive a SD card or MMC card will be configured to receive both configurations.

Figure 4A:
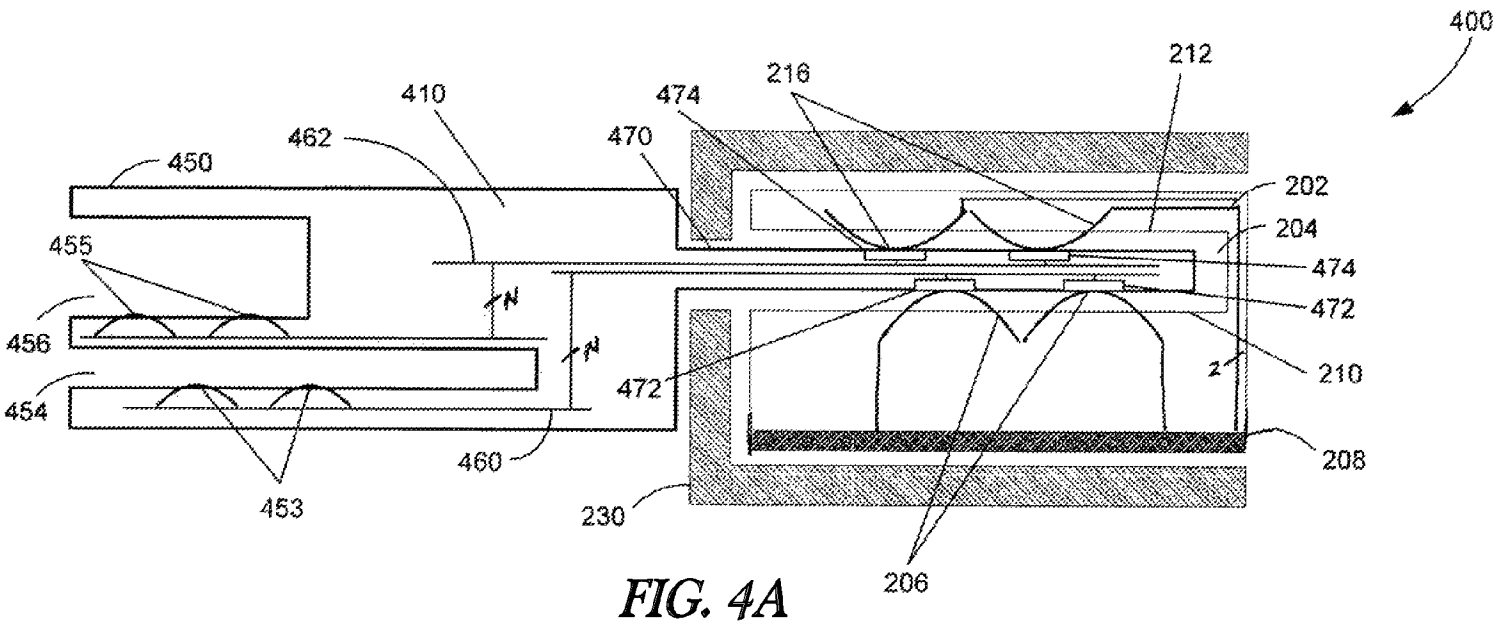
FIG. 4A is a cross-sectional view of a block diagram representation of memory card compatible receptacle in operative engagement with one example of port expansion device 410.

FIG. 4A is a cross-sectional view of a block diagram representation 400 of memory card-compatible receptacle 202 in operative engagement with one example of a port expansion device 410. As noted previously, memory card-compatible receptacle 202 can be integrated into a processing system 230 (such as, for example, system 102 of FIG. 1). Port expansion device 410 is configured to operably couple an electronic device to system 230 wherein the electronic device has a connector interface different from the memory card for which the memory card-compatible receptacle 202 is configured. This allows the coupling of devices to the processing system through use of ports other than the memory cards for which the memory card receptacle is designed. In most configurations, the port expansion device 410 will be easily removable from the receptacle.

Port expansion device 410 includes a connector portion 470, which engages the memory card receptacle 202, and a receptacle portion 450 that engages connectors for other devices (again, directly or through a cable, dongle, etc.). The receptacle portion 450 is operably coupled to the connector portion 470. Addressing first the connector portion 470, it is configured to physically engage the memory card receptacle 202, and to electrically engage the contacts therein. As noted previously, memory card-compatible receptacle 202 includes a first set of contacts 206 and a second set of contacts 216 within the space 204, with the second set of contacts 216 at a location different from the first set of contacts 206. In the depicted example, the first set of contacts 206 is located proximate the bottom surface 210, and the second set of contacts 216 is located proximate the top surface 212, in generally opposing relation to the bottom surface 210; each to engage a card-sized device that is inserted. While this is one desirable configuration, it would also be possible to place all contacts on the same side of card-receiving space 204. Also as noted previously, the first set of contacts 206 is configured to engage a set of contact surfaces of a memory card. The memory card-compatible receptacle 202 is in communication with a communication portion 208, to permit electrical communication between at least some of the contacts of the first and second sets of contacts 206 and 216 of memory card-compatible receptacle 202 and other components of the processing system 230, such as a processor. The various options for facilitating such communication should be apparent to those skilled in the art in view of this disclosure. For example, a port connector will typically communicate signals to other system, implemented in hardware, software or a combination of the two, to control communication to and from the connector, and thus to the device(s) coupled to the connector. One suitable configuration is for communication portion 208 to establish communication with such conventional hardware and/or software that would provide such functionality in the same manner as if the connectors of the receptacle portion of port extension device 410 were integral to the host system.

In this example, the connector portion 470 includes a first set of contact surfaces 472 configured to respectively engage the first set of contacts 206 of the memory card-compatible receptacle 202. In this example embodiment, the configuration of the first set of contact surfaces 472 is of the same configuration as a memory card (such as one of the memory cards 302 and 312 described with reference to FIGS. 3A-3D above). In an alternative embodiment, (and as noted above) memory card-compatible receptacle 202 may include additional contacts on the same surface as the first set of contacts 206; and port expansion device 410 can include an additional set of contact surfaces to engage some or all of those additional contacts.

The connector portion 470 also includes a second set of contact surfaces 474 configured to engage the second set of contacts 216 of receptacle 202. The second set of contacts 216 may be arranged in virtually any desired pattern, whereas the first set of contacts 206 must conform to the pre-established pattern of the memory card. Thus, the arrangement of the second set of contacts 216 and of contact surfaces 474 can be in any desired complimentary pattern. Additionally, in some configurations, there may be a greater number of contacts in the second set 216 than are present in the contact surfaces 474 of a particular expansion device 410. For example, such a configuration may be used to accommodate different configurations of expansion devices configured to engage the single receptacle 202, and such different configurations might engage different groups of contacts in second set of contacts 216. For example, expansion devices might have different numbers or combinations of port connectors, and the different ports may be configured to communicate with different sets of contacts, where the contacts are either of completely different sets, or where some contacts of the sets are shared. As another example, either set of contacts may include a greater number of contacts than the contacts of a memory card, and the connection portion can include contact surfaces arranged to engage the additional contacts.

The receptacle portion 450 of the port expansion device 410 is operably coupled (electrically, in the depicted example) to the connector portion 470 through one or more bus lines 460 and 462. The receptacle portion 450 is configured to receive one or more connectors or other electronic devices that are different than the memory card configuration that the memory card-compatible receptacle 202 is configured to receive. The receptacle portion 450 extends outward from the system 230 when the connector portion 470 is engaged within the memory card-compatible receptacle 202. In the depicted example, the connector portion 470 of the port expansion device 410 has a rigid external body structure; in other configurations, port expansion device 410 may include a flexible component such as a cable extending between the connector portion 470 and the receptacle portion 450.

In the depicted example, receptacle portion 450 of port expansion device includes four port connectors to engage external devices. These port connectors include a MMC card port connector 454 (the same card that receptacle 202 is configured to receive); an Ethernet port connector 456, and two additional port connectors, depicted in block representation, which, if present at all, may be of any desired configuration, such as for any of the ports discussed earlier herein. For example, one useful configuration might be for one connector to be for a USB port and the other to be for a Firewire (400 or 800) port.

In this example, MMC card port connector 454 has a configuration and contacts 453 configured to engage a memory card (as previously described). Ethernet port connector 456 has a configuration and shape to engage an Ethernet connector. In the depicted example, the receptacle portion 450 includes two additional port connectors, 457, 459, depicted in block representation. As will be apparent to those skilled in the art having the benefit of this disclosure, the two additional port connectors 457 and 459 will have a configuration and contact arrangement compatible with the connectors for that port type.

In this example, because MMC card port connector 454 is, in effect, an extension of the receptacle 202, one convenient arrangement is for the contacts 453 of that port connector to be connected in the port expansion device, such as being hardwired, to the respective contact surfaces 472 that will engage the corresponding contacts in the first set 206. In that way, signals will be communicated, in effect, as if a MMC card engaging port 454 were directly engaging receptacle 202. In that configuration, it will be desirable in many examples for the Ethernet port connector 456, as well as the connectors for the additional ports 457, 459, to be coupled to communicate with the host system through contact surfaces 474 and the second set of contacts 216 via contacts 455. In some configurations, the contacts of the Ethernet port 456, as well as ports 457 and 459 can have one or more direct and dedicated connections to an appropriate contact surface 474; while in other configurations, shared bus lines may be used for two or more of the ports. Additionally, in other examples, two or more of the ports in the port expansion device can share communication with contacts in either set, or both, sets of contacts 206 and 216 in receptacle 202. For example, for some compatible port configurations sharing of (at least) power and ground contacts may be appropriate and useful.

In various configurations, the port expansion device 410 and/or the system 230 (e.g., memory card-compatible receptacle 202) can include additional circuitry to provide additional functionality for the ports 454, 456, 457 and 459 in receptacle portion 450. For example, some configurations can include a detect circuit for determining what type of electrical devices are connected to and/or connectable with the port expansion device 410. Additionally, the expansion system 400 may include a reconfiguration circuit for reconfiguring the first and second port 454 and 456 to the specifications of a device connected to that port. One such example is determining the voltage requirement for a device operably engaged with the port. In other embodiments, the memory card-compatible receptacle 202 can include any combination of the detect circuit and one or more other types of configuration circuits, as would be known to those skilled in the art having the benefit of the present disclosure.

Figure 4B:
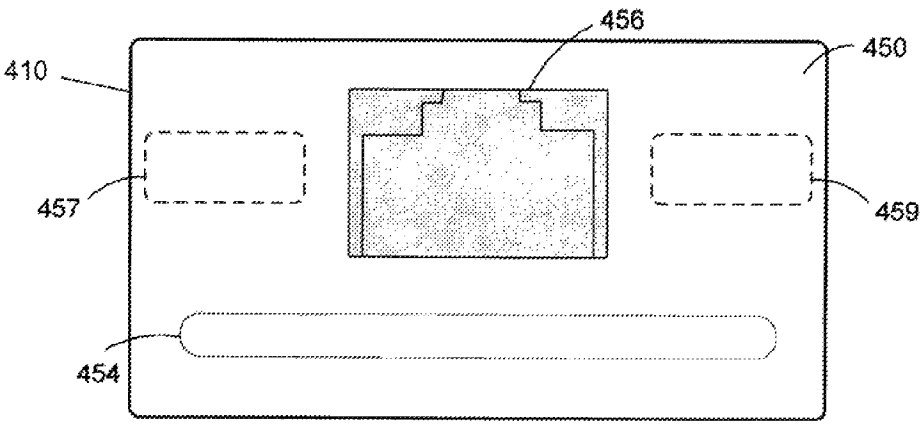
FIG. 4B is a frontal view of a port expansion device of FIG. 4A with four receptacles.

It should be clearly understood that the described port expansion device is not in any way limited to the number or configuration of ports depicted herein. Port extension devices that provide just a single alternative port connection are very useful. For example, such a device can be used to add the ability to connect the much bulkier Ethernet port connector to a device that has a dimension that can accommodate only the much thinner card receptacle. Additionally, even in the depicted configuration, the unspecified ports 457 and 459 can be configured to receive any combination of the following connectors: Ethernet, FireWire, USB, MMC, SD, VGA, PS/2, Mini DisplayPort, Gigabit Ethernet, audio (input or output) or the like. Additionally the port expansion device could be configured to provide and/or communicate with an optical connector. In other examples, the port expansion device can be configured with greater or lesser number of ports than that depicted in FIG. 4; and in some configurations all ports can be configured to engage memory cards such as those depicted in FIGS. 3A-3D. Additionally, although depicted with dissimilar ports in FIG. 4B, the port expansion device may be configured to provide access to two or more similar ports (e.g., multiple memory card ports or FireWire ports, etc.).

Figure 5:
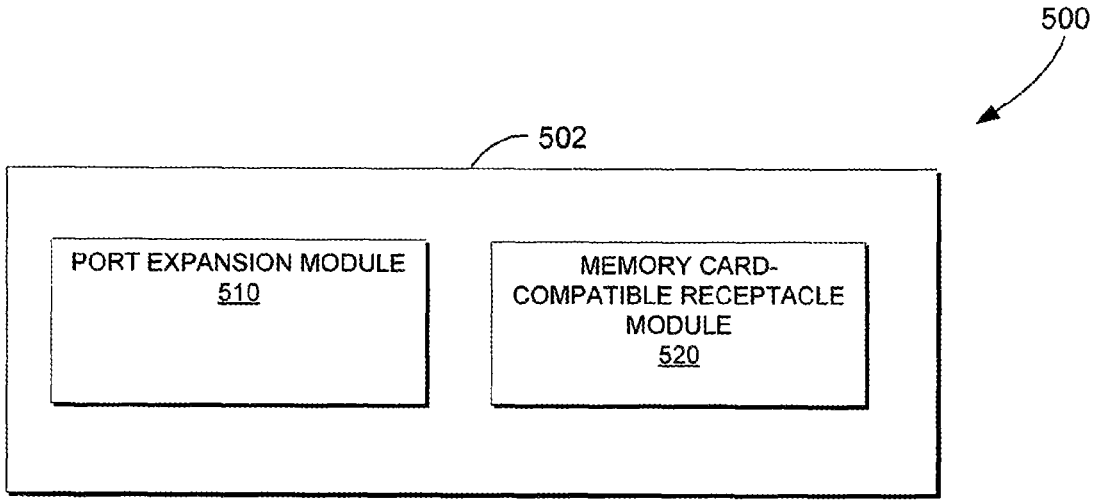
FIG. 5 is a block diagram of an example processing device with a port expansion module and a memory-card compatible receptacle module.

FIG. 5 is a block diagram 500 of an example apparatus 502 with a port expansion module 510 and a memory-card compatible receptacle module 520. The example apparatus 502 includes hardware (including a processor), machine-readable storage media and additional components well-known to those skilled in the art; and will further include an operating system and/or other programs facilitating the operation of the system, and also of a plurality of modules, implemented in hardware, software, or a combination of the two. The apparatus 502 engages a port expansion device with a memory card-compatible receptacle, wherein the port expansion device is configured to engage one or more electrical devices with a configuration different from a memory card which the memory card-compatible receptacle is configured to engage. In the example, the port expansion device includes one or more ports for operably connecting an external device to the apparatus.

The port expansion module 510 can include port expansion logic such as for determining whether the port expansion module 510 is connected to the memory card-compatible receptacle module 520. Similarly the memory card-compatible receptacle module 520 can include receptacle logic for determining whether a port expansion device is connected and engaged within the receptacle of the memory card-compatible receptacle. The modules can further include a detection module such as for determining whether an electrical device is connected to one or more receptacles of the receptacle portion of the port expansion portion of the apparatus 502 and/or which electrical device is connected with the one or more receptacles of the apparatus 502. Additionally, the port expansion module 510 and/or the memory card-compatible receptacle module 520 can include an engaged contacts module such as for determining which contacts of the memory card receptacle are coupled to a connector of an electrical device (e.g., memory card, Ethernet connector, etc.). As just one example, if a port expansion device was coupled to the apparatus, but only had a device coupled to an Ethernet port, but not to other ports, then systems associated with the powering or operation of those other ports could be disabled to conserve battery life. The port expansion module 510 and/or the memory card-compatible receptacle module 520 can include a communication module for communicating with other components of the apparatus 502 including a processor.

It should be appreciated that in other embodiments, the apparatus 502 may include fewer or more modules from those shown in FIG. 5. For example, a voltage adjustment module may be include in either or both of the port expansion module 510 and the memory card-compatible receptacle module 520, such as to facilitate adjustment of the voltage needed to operably couple an electrical device to the apparatus 502.

Additionally, as with modules depicted in FIG. 5, each module may be implemented in software, firmware, or hardware to provide alternative structures functionally beyond those specifically discussed in reference to FIG. 5. When a module is implemented wholly or in part through software, then the system will include machine-readable storage media configured to contain (temporarily, or persistently) the instructions implemented by the processor to perform the operations of the software. The modifications or additions to the structures described in relation to FIG. 5 to implement these alternative or additional functionalities will be implemented by those skilled in the art having benefit of the present specification and teachings.

Figure 6:
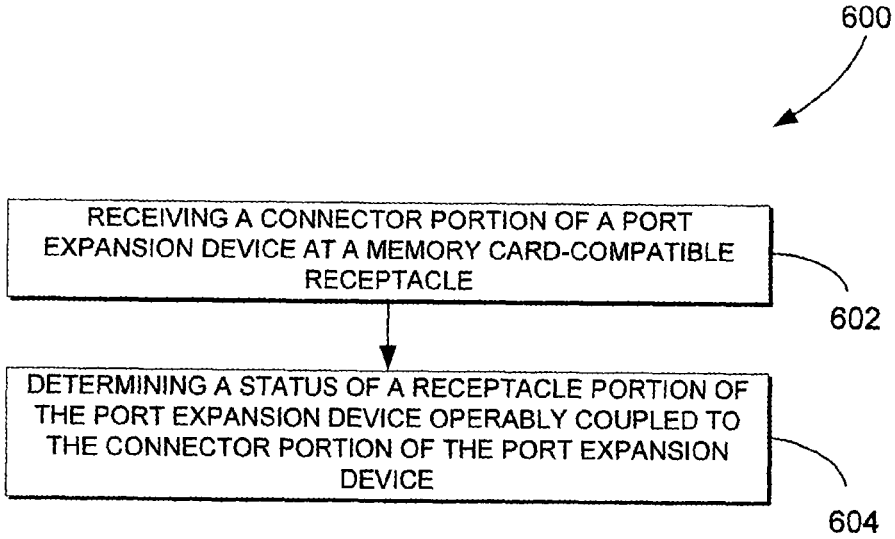
FIG. 6 illustrates a method of determining a status of a port expansion device.

FIG. 6 illustrates a method 600 of determining a status of a port expansion device. The port expansion device is engaged with a memory card-compatible receptacle and configured to receive an electrical device different from a memory card for which the memory card-compatible receptacle is configured to receive. At block 602, the method 600 begins by receiving a connector portion of a port expansion device at a memory card-compatible receptacle. The method 600 continues at block 604 where the method 600 determines a status of a receptacle portion of the port expansion device operably coupled to the connector portion of the port expansion device. In some embodiments, the method 600 provides simultaneous connectivity to more than one electrical device connected with the receptacle portion of the port expansion device.

In an example embodiment, determining the status at block 604 can include determining which electrical device or devices are connected to the receptacle portion of the port expansion device, whether connected electrical devices require voltage adjustment for functionality of the electrical devices, and/or distribution of contacts within the memory card-compatible receptacle to accommodate the electrical devices. In an example embodiment, determining the status at block 604 can include determining an identification value from an electrical device connected with the receptacle portion of the port expansion device.

In some embodiments, the status determination of block 604 can be determined by the memory card-compatible receptacle portion or the processing system operably coupled to the memory card-compatible receptacle portion. In other embodiments, some of that functionality can be placed win the expansion device, with the device having a controller operable to perform the status determination (or other desired operations). In other embodiments, the status determination functionality may be a shared operation distributed between the device and the host system.

Various embodiments or combination of embodiments for apparatus and methods, as described herein, can be realized in hardware implementations, software implementations, and combinations of hardware and software implementations. Implementations including software will include a machine-readable medium having machine-executable instructions, such as a computer-readable medium having computer-executable instructions, for performing the described operations. The machine-readable medium is not limited to any one type of medium.

Although specific embodiments have been illustrated and described herein, it will be appreciated by those of ordinary skill in the art that any arrangement that is calculated to achieve the same purpose may be substituted for the specific embodiments shown. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description.

What is claimed is:

1. A port expansion device configured to engage a memory card-compatible receptacle, comprising:

a connector portion configured to engage the memory card-compatible receptacle, the connector portion having a first set of contact surfaces on a first surface, a second set of contact surfaces on a second surface, the second surface opposing the first surface, and a first end perpendicular to the first and second surfaces, wherein the first set of contact surfaces are configured to engage at least some contacts of a first of contacts with the memory card-compatible receptacle and the second set of contact surfaces are configured to engage at least some contacts of a second set of contacts within the memory card-compatible receptacle; and a receptacle portion operably coupled to a second end of the connector portion that is opposite the first end of the connector portion, and having a connector configured to receive a complimentary connector associated with an electrical device, the complimentary connector having a configuration different from the memory card for which the memory card-compatible receptacle is configured, wherein the receptacle portion is configured to extend outwards from the connector portion and from the memory card-compatible receptacle when the connector portion is engaged with the memory card-compatible receptacle.

2. The port expansion device of claim 1, wherein the receptacle portion is configured to simultaneously engage more than a complimentary connector.

3. The port expansion device of claim 1, wherein the receptacle portion is configured to receive a universal serial bus (USB) connector.

4. The port expansion device of claim 1, wherein the receptacle portion is configured to receive a Firewire connector.

5. The port expansion device of claim 1, wherein the receptacle portion is configured to engage a plurality of types of connectors.

6. The port expansion device of claim 5, wherein a first port of the receptacle portion is configured different from a second port of the receptacle portion and the memory card-compatible receptacle.

7. The port expansion device of claim 5, wherein a first port of the receptacle portion is configured substantially the same as a second port of the receptacle portion and the memory card-compatible receptacle.

8. The port expansion device of claim 5, wherein a first port of the receptacle portion is configured to receive a USB connector and a second port of the receptacle portion is configured to receive a FireWire connector.

9. A processing device system comprising:

a processing device comprising:

a memory card-compatible receptacle configured to engage a port expansion device, the memory card-compatible receptacle comprising:

a first set of contacts within the receptacle configured to engage a first set of contact surfaces, where the first set of contact surfaces are all the contact surfaces of a memory card configuration which the memory card-compatible receptacle is configured to engage; and a second set of contacts within the receptacle configured to engage a second set of contact surfaces, wherein the second set of contacts are at a location different from the first set of contacts; and the port expansion device comprising:

a connector portion configured to engage the memory card-compatible receptacle, the connector portion having a first set of contact surfaces on a first surface, a second surface opposing the first surface, and a first end perpendicular to the first and second surfaces, wherein the first set of contact surfaces are configured to engage with the first set of contacts of the memory card-compatible receptacle, the connector portion further having a second set of contact surfaces where the second set of contact surfaces are configured to engage with at least some of the second set of contacts of the memory card-compatible receptacle; and a first port, operably coupled to a second end of the connector portion and is opposite the first end of the connector portion, and configured to receive an electrical connector associated with an electrical device, the electrical device having a configuration different from a memory card for which the memory card-compatible receptacle is configured, wherein the first port is configured to extend outwards from the connector portion and from the memory card-compatible receptacle when the connector portion is engaged with the memory card-compatible receptacle.

10. The system of claim 9, wherein the port expansion device further comprises a second port configured to engage a memory card simultaneously with the electrical device of the first port.

11. The system of claim 10, wherein the first port and the second port have the same configuration.

12. The system of claim 10, wherein the first and second ports are configured to each be one of a USB port and a Firewire port.

13. The system of claim 9, wherein the memory card-compatible receptacle is configured to receive at least one of an SD card and MMC connector.

14. The system of claim 9, wherein the first port is a universal serial bus (USB) connector.

15. The system of claim 9, wherein the first port is a Firewire connector.

16. A method for expanding a memory card-compatible receptacle, the method comprising:

receiving a connector portion of a port expansion device at a memory card-compatible receptacle, the memory card-compatible receptacle comprising:

a first set of contacts located on a first side of the receptacle; and a second set of contacts located on a second side of the receptacle, wherein the second side opposes the first side, and the connector portion of the port expansion device comprising a first set of contact surfaces and a second set of contact surfaces, wherein at least one of the first set of contact surfaces of the connector portion engages with at least one of the first set of contacts and at least one of the second set of contact surfaces of the connector portion engages with at least one of the second set of contacts of the memory card-compatible receptacle;

determining a status of a receptacle portion of the port expansion device operably coupled to the connector portion of the port expansion device, wherein the receptacle portion of the port expansion device is configured to extend outwards from the connector portion of the port expansion device and from the memory card-compatible receptacle when the connector portion is engaged with the memory card compatible receptacle; and configuring at least one port of the receptacle portion of the expansion device in response to the determined status.

17. The method of claim 16, wherein determining the status of the reception portion includes determining if electrical devices are connected to the receptacle portion of the expansion device.

18. The method of claim 16, wherein determining the status includes identifying a device connected to at least one port of the receptacle portion of the port expansion device.

19. The method of claim 16, further comprising determining a configuration of a set of contacts of the port expansion device.

20. The method of claim 16, wherein the connector portion further comprises:

a first planar side;

a second planar side opposing the first planar side; and a first end located perpendicular to both the first and second planar sides.

21. The method of claim 20, wherein the receptacle portion of the port expansion device is operably coupled a second end of the connector portion, wherein the second end is opposing the first end.

22. A port expansion device comprising:

a connector portion comprising:

a first surface comprising a first contact configuration that comprises at least a first electrical contact;

a second surface that opposes the first surface and comprises a second contact configuration that comprises at least a second electrical contact; and a first end extending between the first and second surfaces; and a receptacle portion comprising at least a first port and a second port, the first port comprising a first electrical contact coupled to the first electrical contact of the connector portion, the second port comprising a second electrical contact coupled to the second electrical contact of the connector portion.

23. The port expansion device of claim 22, wherein the receptacle portion is located at a side that opposes the first end of the connector portion.

24. The port expansion device of claim 22, wherein the first port is configured to electrically communicate with a first contact configuration.

25. The port expansion device of claim 24, wherein the second contact configuration is configured different from the first contact configuration.

* * * * *